United States Patent [19]

Capriotti

[11] 4,157,744

[45] Jun. 12, 1979

[54] LUBRICATING AND COOLING ENGINE SYSTEM COMPONENT

[76] Inventor: Lawrence J. Capriotti, 44 Pearl St., Somerville, Mass. 02184

[21] Appl. No.: 816,581

[22] Filed: Jul. 18, 1977

[51] Int. Cl.[2] ..... F01M 1/16; F01M 5/00

[52] U.S. Cl. ..... 184/6.3; 60/39.08; 123/196 S; 184/6.11; 184/104 B

[58] Field of Search ..... 184/6.3, 6.4, 6.11, 184/6.22, 104 B; 60/39.08; 123/196 AB, 196 S

[56] References Cited

U.S. PATENT DOCUMENTS

| | | | |
|---|---|---|---|
| 2,751,749 | 6/1956 | Newcomb | 184/6.3 X |
| 3,057,436 | 10/1962 | Jacobson et al. | 184/6.3 |
| 3,422,807 | 1/1969 | Waldecker | 184/6.3 X |
| 3,486,582 | 12/1969 | Carter et al. | 184/6.3 |
| 3,722,623 | 3/1973 | Waldecker | 184/6.3 |
| 3,827,236 | 8/1974 | Rust | 60/39.08 X |
| 3,917,027 | 11/1975 | Hakanson et al. | 184/6.3 |
| 4,061,204 | 12/1977 | Kautz | 123/196 S X |

FOREIGN PATENT DOCUMENTS

| | | | |
|---|---|---|---|
| 1357236 | 6/1974 | United Kingdom | 184/6.3 |

*Primary Examiner*—David H. Brown

[57] ABSTRACT

A system for pre-lubricating and post-shutdown cooling of an automotive engine system component, such as a turbocharger, comprising a first tank having an oil inlet, an oil outlet, oil cooling means, and pressure means responsive to accumulation of oil in the tank to pressurize the oil therein, a second tank having an oil inlet, an oil outlet, and pressure means responsive to accumulation of oil in the second tank to pressurize the oil therein, input conduit means connected to supply oil to the inlets during engine operation, first output conduit means connected between the first tank outlet and the component, second output conduit means connected between the second tank outlet and the component, and valve means normally preventing flow in the second output conduit means but responsive to engine cranking to permit flow from the second tank to the component.

7 Claims, 2 Drawing Figures

FIG 1
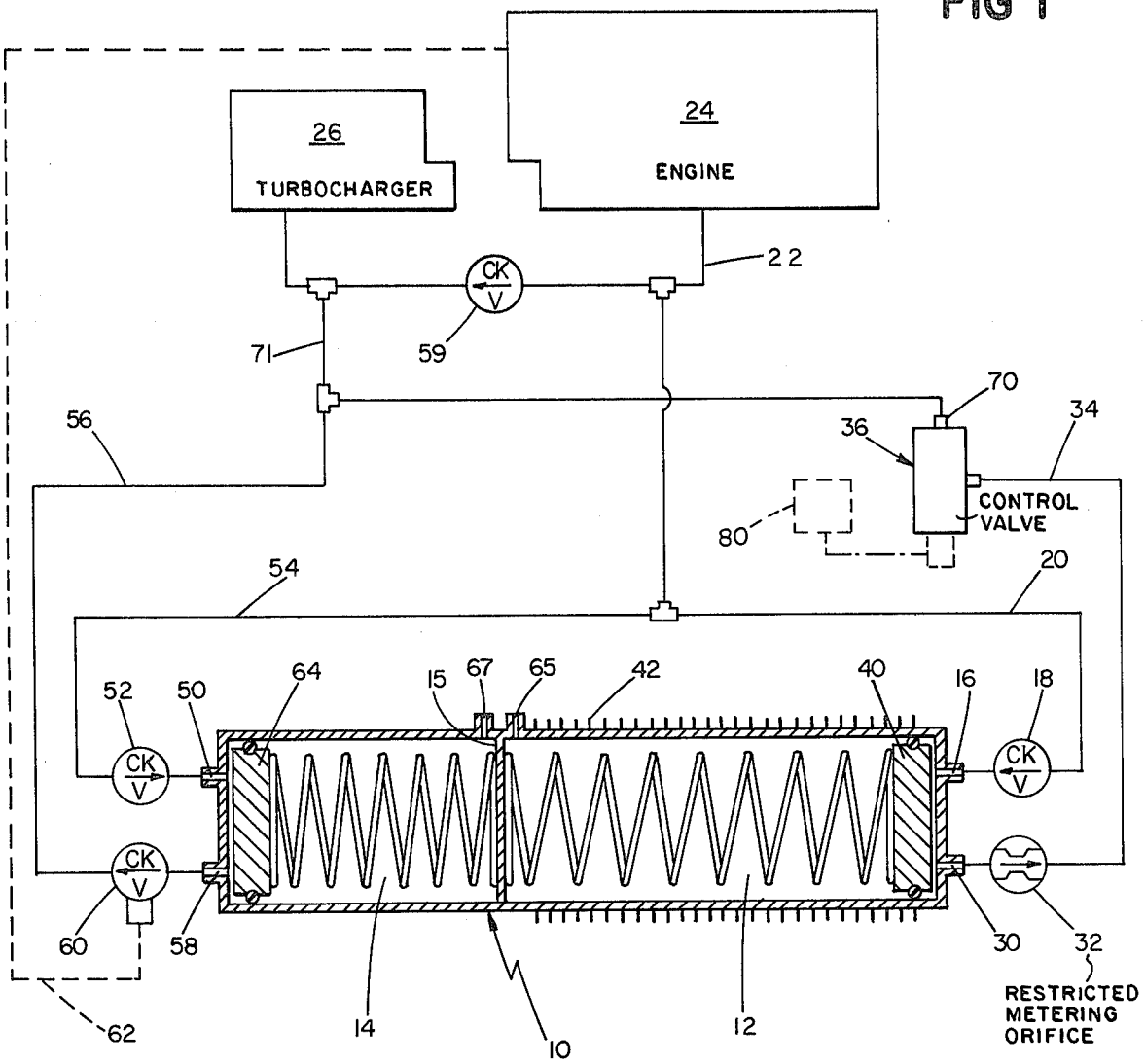
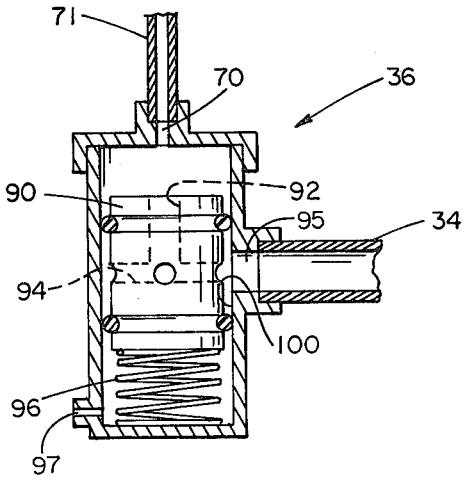
FIG 2

LUBRICATING AND COOLING ENGINE SYSTEM COMPONENT

BACKGROUND OF THE INVENTION

This invention relates to the lubrication and cooling of automotive engine system components, particularly turbochargers.

Turbochargers are typically supplied with lubricating and cooling oil from the engine oil line. As a result, when the engine is shut off cooling oil is no longer supplied to the turbocharger, and residual heat in the mechanism can cause damage. Efforts have thus been made to supply oil to the turbocharger after shutdown, e.g., using an auxiliary pump system as in Rust U.S. Pat. No. 3,827,236.

Oil supply prior to engine start-up is also desirable in order to prevent damage from operation prior to effective receipt of oil from the engine line. Pre-lubrication devices are summarized, e.g., in Holcomb U.S. Pat. No. 3,583,525. In Holcomb, as well as in Raichel U.S. Pat. No 3,583,527, oil is accumulated under compressed air pressure in a reservoir during engine operation, and released upon start-up. Hakanson, et al., U.S. Pat. No. 3,917,027 shows a spring-biased piston; the piston moves against the spring during discharge.

Anders U.S. Pat. No. 2,990,915 uses spring-biased pistons in chambers to take over supply of oil to an injection pump when the normal supply fails.

SUMMARY OF THE INVENTION

The invention provides a reliable, inexpensive, easily manufactured and installed device for automatically supplying both pre-lubrication and post-shutdown cooling. At the same time an auxiliary oil supply useful with operating accessories (e.g., clutch fan, alternator, etc.) is made available.

In general, the invention features bleeding oil from the main oil supply line during engine operation to fill a pair of tanks with oil under compression. Upon engine shutdown a control valve opens to permit cooled oil to flow from one tank to the engine system component. Upon recranking another valve opens to permit flow of pre-lubricating oil from the second tank to the component. In preferred embodiments spring-biased pistons provide the compression in the tanks.

Other advantages and features of the invention will appear from the description and drawing of a preferred embodiment thereof.

BRIEF DESCRIPTION OF THE DRAWING

FIG. 1 is a semi-schematic diagram of the invention; and FIG. 2 is a view partly broken away of a control valve.

DESCRIPTION OF THE PREFERRED EMBODIMENT

Referring to the drawing, housing 10 is divided into tanks 12 and 14 by partition 15.

Referring first to tank 12, oil inlet 16 is connected through check valve 18 to line 20 tapped off the main oil supply line 22 between engine 24 and turbocharger 26. Oil outlet 30 has a restricted metering orifice member 32 from which outlet line 34 leads to control valve 36. Inside the tank is spring loaded piston 40 facing the inlet and outlet. On the exterior of the tank are cooling fins 42.

Tank 14 has oil inlet 50 connected through check valve 52 to line 54 also tapped off main line 22. Oil outlet line 56 extends between tank outlet 58 and line 22 between turbocharger 26 and check valve 59, and includes a check valve 60 with a control connection (e.g., electrical for solenoid operation, or air for pneumatic operation, etc.) 62 to the engine. Spring loaded piston 64 inside the tank faces the inlet and outlet.

Vents 65 and 67 are provided in tanks 12 and 14, respectively.

Control valve 36 has an outlet 70 also connected via line 71 to line 22 between turbocharger 26 and check valve 59. Valve 36 is of any suitable type capable of response to pressure conditions in main line 22 so as to be closed when line 22 has normal operating pressure, blocking oil flow from line 34 into line 22, and open when the pressure in line 22 drops off upon engine shutdown. Optionally, a manually operable override control 80 is connected to valve 36 to permit opening of the valve for supplying auxiliary oil even when the engine is operating.

A preferred embodiment of valve 36 is shown in FIG. 2. Piston 90 has an axial passage 92 communicating with radial passages 94. Spring 96 is arranged to bias piston 90 in an open position with passages 94 communicating with inlet 95 connected to line 34 and passage 92 communicating with outlet 70. But spring 96 is too light to resist normal operating oil pressure in lines 22 and 71, which thus forces piston 90 down so that passages 94 are blocked by housing wall 100. Vent 97 is provided in the housing of the valve.

During engine operation oil from line 22 fills tanks 12 and 14 and is stored therein under the pressure of pistons 40 and 64. Fins 42 cool the oil in tank 12. When the engine shuts down valve 36 opens to permit oil from tank 12, forced out by piston 40, to flow through lines 34, 71, and 22 to continue cooling of the turbocharger. Later, upon recranking of the engine, valve 60 opens for a brief period to instantly supply oil, forced out of tank 14 by piston 64, to the turbocharger through lines 56, 71, and 22 for pre-lubrication. Valve 60 closes as the cranking mechanism stops. As the engine continues to run tanks 12 and 14 are refilled.

Other embodiments (e.g., use of oil from tanks 12 or 14 or both to lubricate other engine system components, e.g., engine bearings or the like, etc.) are within the following claims.

I claim:

1. A system for pre-lubricating and post-shutdown cooling of an automotive engine system component, such as a turbocharger, comprising a first tank having an oil inlet, an oil outlet, oil cooling means, and pressure means responsive to accumulation of oil in said tank to pressurize said oil therein, a second tank having an oil inlet, an oil outlet, and pressure means responsive to accumulation of oil in said second tank to pressurize said oil therein, input conduit means connected to supply oil to said inlets during engine operation, first output conduit means connected between said first tank outlet and said component, second output conduit means connected between said second tank outlet and said component, and valve means normally preventing flow in said second output conduit means but responsive to engine cranking to permit flow from said second tank to said component.

2. The system of claim 1 wherein each of said tanks has its inlet and outlet in an end wall, and each said pressure means is a spring-biased piston facing its respective end wall.

3. The system of claim 1 wherein said component is a turbocharger.

4. The system of claim 1 wherein both said supply conduit means are tapped off the main oil line supplying oil to said component during engine operation.

5. The system of claim 1 wherein said tanks comprise a partitioned housing.

6. The system of claim 1 further comprising a control valve in said first output conduit responsive to oil pressure conditions in the portion of conduit adjacent said component to block flow in said conduit in the presence of normal engine oil supply pressure in said conduit portion during engine operation, and to permit flow from said first tank to said component upon a drop in said pressure.

7. The system of claim 6 wherein said control valve comprises a piston having one face exposed to said conduit portion and the opposite face adjacent a spring; said spring being selected to bias said piston in a valve-open position at low pressure in said conduit portion, and to be overcome by normal engine oil supply pressure to permit movement of said piston to a valve-closed position.

* * * * *